United States Patent [19]

Muller et al.

[11] 4,316,066

[45] Feb. 16, 1982

[54] KEY SWITCH WITH SNAP-ACTION CONTACT AND RESILIENT ACTUATOR

[75] Inventors: Michael Muller, Newport Beach; Reed A. Palmer, Irvine; Harry R. Marker, Costa Mesa, all of Calif.

[73] Assignee: International Telephone and Telegraph Corporation, New York, N.Y.

[21] Appl. No.: 211,428

[22] Filed: Nov. 28, 1980

Related U.S. Application Data

[63] Continuation of Ser. No. 73,994, Sep. 10, 1979, abandoned.

[51] Int. Cl.[3] ..... H01H 5/20; H01H 13/38

[52] U.S. Cl. ..... 200/670; 200/159 A; 200/5 A; 200/292

[58] Field of Search ..... 200/67 D, 67 DA, 159 A, 200/340, 5 R, 5 A, 292, 303

[56] References Cited

U.S. PATENT DOCUMENTS

| | | | |
|---|---|---|---|
| 3,062,932 | 11/1962 | Korsgren et al. | 200/67 D |
| 3,281,552 | 10/1966 | Tennant | 200/67 D |
| 3,800,104 | 3/1974 | Lien et al. | 200/159 A |
| 3,899,648 | 8/1975 | Murata | 200/67 DB |
| 3,909,564 | 9/1975 | Scheingold et al. | 200/292 |
| 3,989,914 | 11/1976 | Stearley et al. | 200/67 D |
| 4,032,728 | 6/1977 | Oelsch | 200/159 A |
| 4,099,037 | 7/1978 | Hartzler et al. | 200/159 A |
| 4,177,367 | 12/1979 | Tirone et al. | 200/159 A |

FOREIGN PATENT DOCUMENTS

| | | |
|---|---|---|
| 514163 | 11/1939 | United Kingdom . |
| 536357 | 5/1941 | United Kingdom . |
| 629949 | 10/1949 | United Kingdom . |
| 655549 | 7/1951 | United Kingdom . |
| 690220 | 4/1953 | United Kingdom . |
| 979800 | 1/1965 | United Kingdom . |

*Primary Examiner*—John W. Shepperd
*Attorney, Agent, or Firm*—Thomas L. Peterson

[57] ABSTRACT

A key switch for data-entry keyboards and the like, the switch having a housing supporting a snap-action spring with a movable contact positioned adjacent a fixed contact on the housing. An actuator leaf spring is anchored at one end to the housing, and has a free end which is movable to drive the snap-action spring between first and second bi-stable positions to operate the switch. A keystem is slidably supported in the housing, and has a portion in contact with the actuator spring so depression of the keystem displaces the actuator spring to drive the snap-action spring.

22 Claims, 23 Drawing Figures

Fig. 14
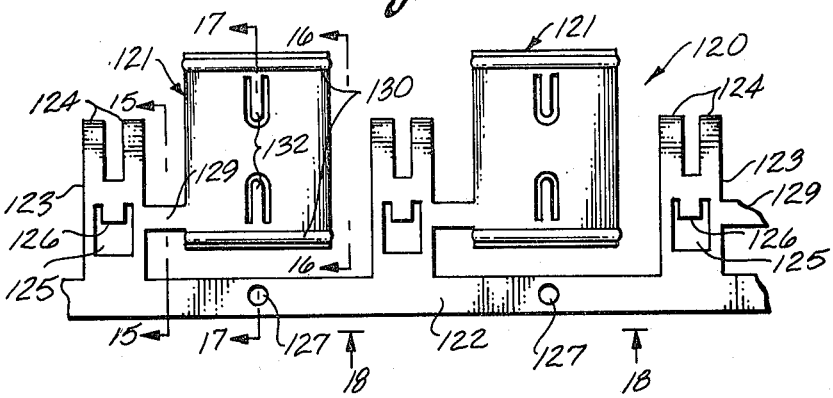
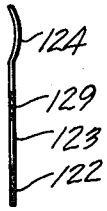
Fig. 15
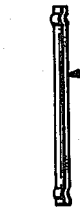
Fig. 16
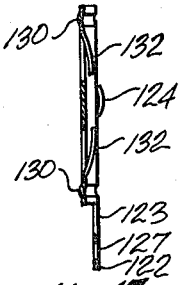
Fig. 17
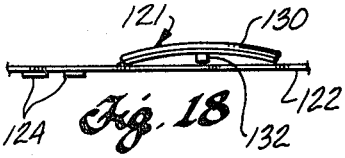
Fig. 18
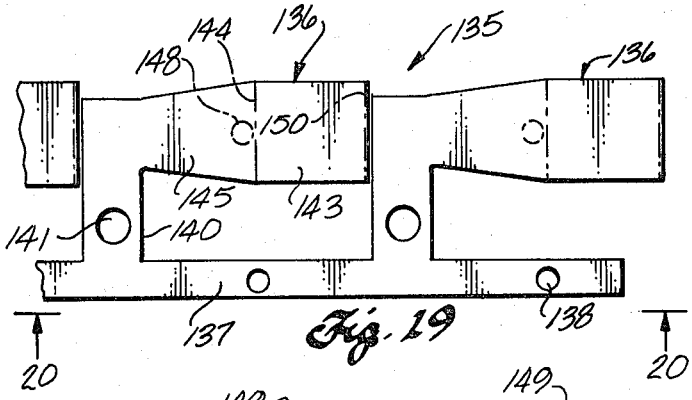
Fig. 19
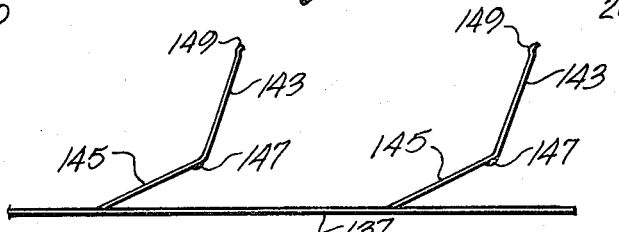
Fig. 20

Fig. 21
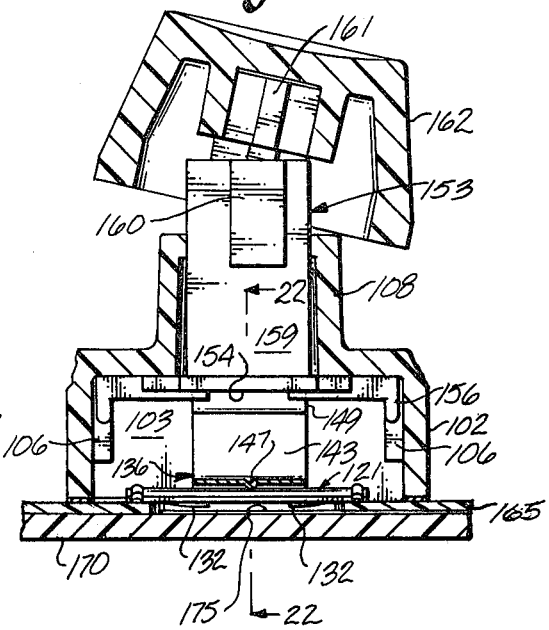
Fig. 22
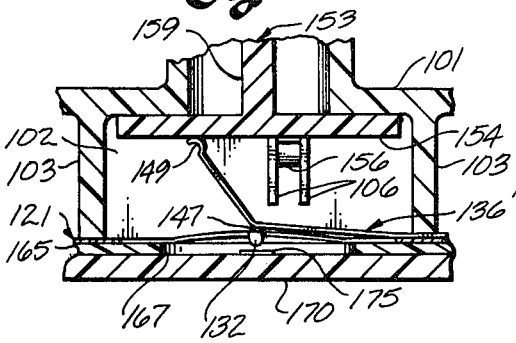
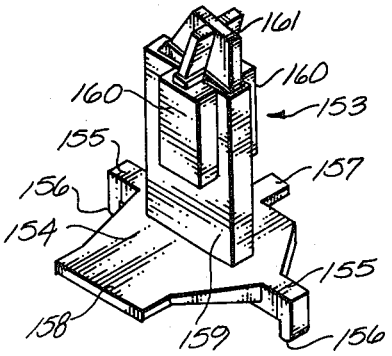
Fig. 23

KEY SWITCH WITH SNAP-ACTION CONTACT AND RESILIENT ACTUATOR

This is a continuation of application Ser. No. 073,994, filed Sept. 10, 1979, now abandoned.

BACKGROUND OF THE INVENTION

Key switches of a variety of styles are in widespread use to enable manual entry of alphanumeric information or other instructions in data-processing equipment, typewriters and teletypes, calculators, and similar equipment. A number of individual key switches, typically of a single-pole single-throw type, are usually clustered together in a common frame to form a keyboard for data entry. Each switch is provided with a key cap which displays a symbol representing the switch function, and which is depressed by an operator to actuate the switch.

Key switches are often the only moving parts in a data-entry system, and it is important that these components be sufficiently rugged to withstand heavy service over a long operating life. It is equally important for the switch to have an actuating stroke which is comfortable for the operator, and which provides a tactile sensing of switch actuation as the key cap is depressed. The switch should also have a hysteresis characteristic in the actuating stroke to avoid switch jitter or multiple actuations if the operator "teases" the switch at the operating point of the actuating stroke. These functions are described in greater detail in U.S. Pat. No. 3,777,090, the disclosure of which is incorporated herein by reference.

The present invention is a new style of key switch which uses relatively few component parts for reduced assembly complexity and manufacturing cost, and which has an overall geometry enabling a number of switches to be grouped together in a compact keyboard. The switch provides a mechanical advantage in that the actuating force sensed by the operator is lower than the spring force urging the contacts together when the switch is closed. The switch also incorporates the desired characteristics of tactile sensing of the actuation point, and hysteresis to prevent "teasing" of the switch closure.

SUMMARY OF THE INVENTION

Briefly stated, the key switch of this invention includes a hollow housing which preferably includes a base, and a cover fitted over and engaged with the base. An elongated keystem is slidably mounted on the housing, and preferably has an upper portion in bearing relationship with the cover and a lower portion in bearing relationship with the base to provide good isolation from keystem side loads. The keystem has a central axis which defines the direction of keystem motion during switch operation.

A pair of leaf springs have first ends which are secured together and to the housing by a terminal pin, the springs being cantilevered across the housing interior to free second ends. One of the springs is a snap-action element which carries a movable contact positioned adjacent a fixed contact on the housing. An actuating force applied to an intermediate portion of the snap-action spring between its first and second ends is effective to drive the spring between first and second bi-stable positions in which the switch contacts are open and closed respectively.

The second leaf spring is an actuator spring having an intermediate portion bearing on the snap-action spring to apply the actuating force. The second end of the actuator spring is laterally displaced from the central axis of the keystem, and is in contact with a tab which extends laterally from the keystem. Depression of the keystem is effective to deflect the second end of the actuator spring, and the resulting force is applied to the snap-action spring to actuate the switch.

The switch is characterized by a small number of simple parts (housing base and cover, keystem, two springs, and two terminal pins), and by a compact, low-profile housing geometry. Keystem side loads are minimized for low-friction operation, and the lower portion of the keystem on the keystem axis preferably passes through clearance openings in the two springs into a blind bore in a supporting and guiding boss on the housing base.

BRIEF DESCRIPTION OF THE DRAWINGS

FIG. 14 is a top plan view of a portion of a strip defining multiple snap-action springs;

FIG. 15 is a view on line 15—15 of FIG. 14;

FIG. 16 is a view on line 16—16 of FIG. 14;

FIG. 17 is a view on line 17—17 of FIG. 14;

FIG. 18 is a view on line 18—18 of FIG. 14;

FIG. 19 is a top plan view of a portion of a strip defining multiple actuator springs;

FIG. 20 is a view on line 20—20 of FIG. 19;

FIG. 21 is a sectional elevation of an individual key switch used in the keyboard;

FIG. 22 is a sectional view on line 22—22 of FIG. 21; and

FIG. 23 is a pictorial view of a keystem.

DESCRIPTION OF THE PREFERRED EMBODIMENT

Figure 1:
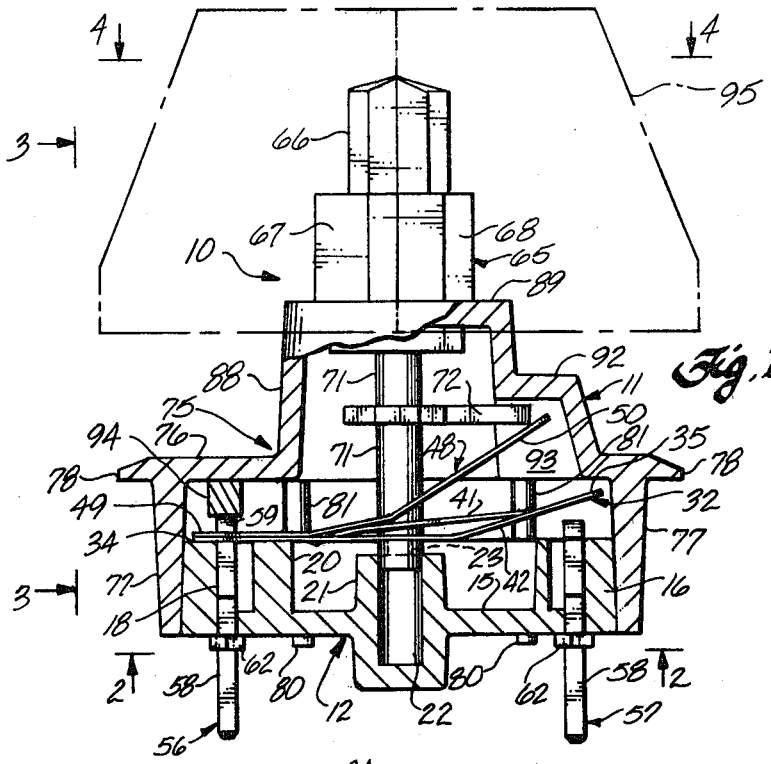
FIG. 1 is an elevation, partly in section, of a key switch according to the invention.
Figure 3:
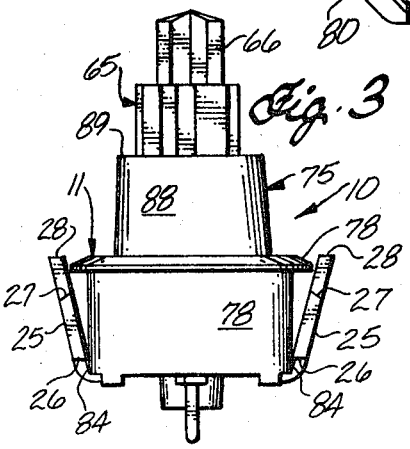
FIG. 3 is a side elevation of the key switch on line 3—3 of FIG. 1.
Figure 4:
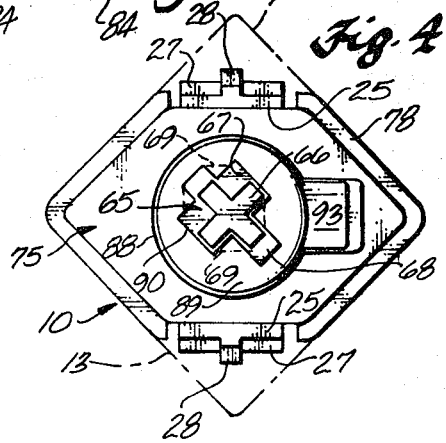
FIG. 4 is a top view of the key switch on line 4—4 of FIG. 1.
Figure 5:
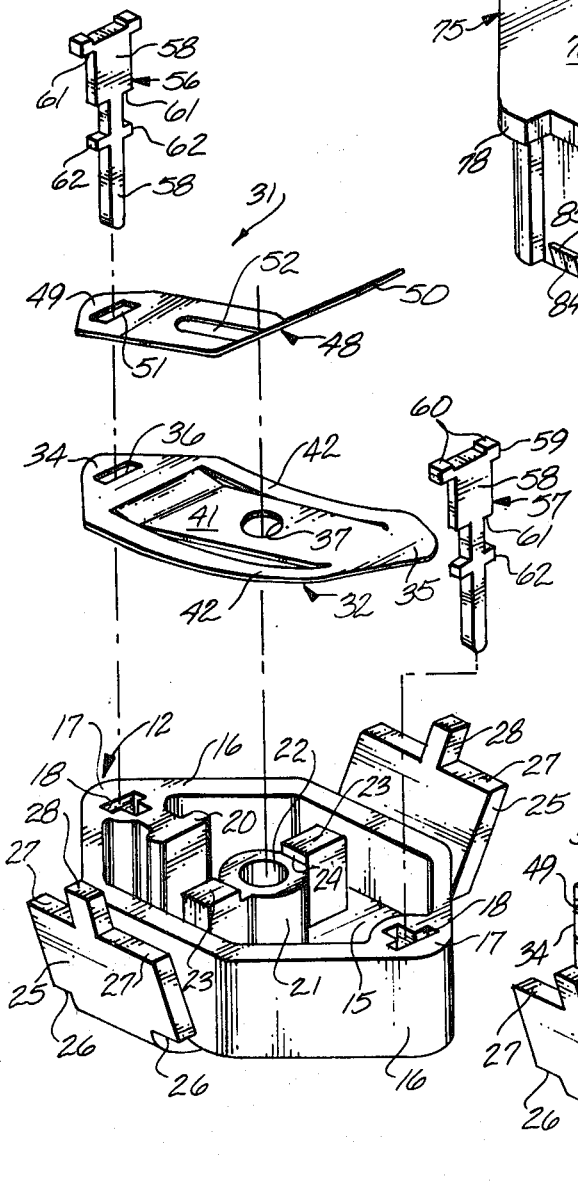
FIG. 5 is an exploded view of a base assembly for the key switch.
Figure 6:
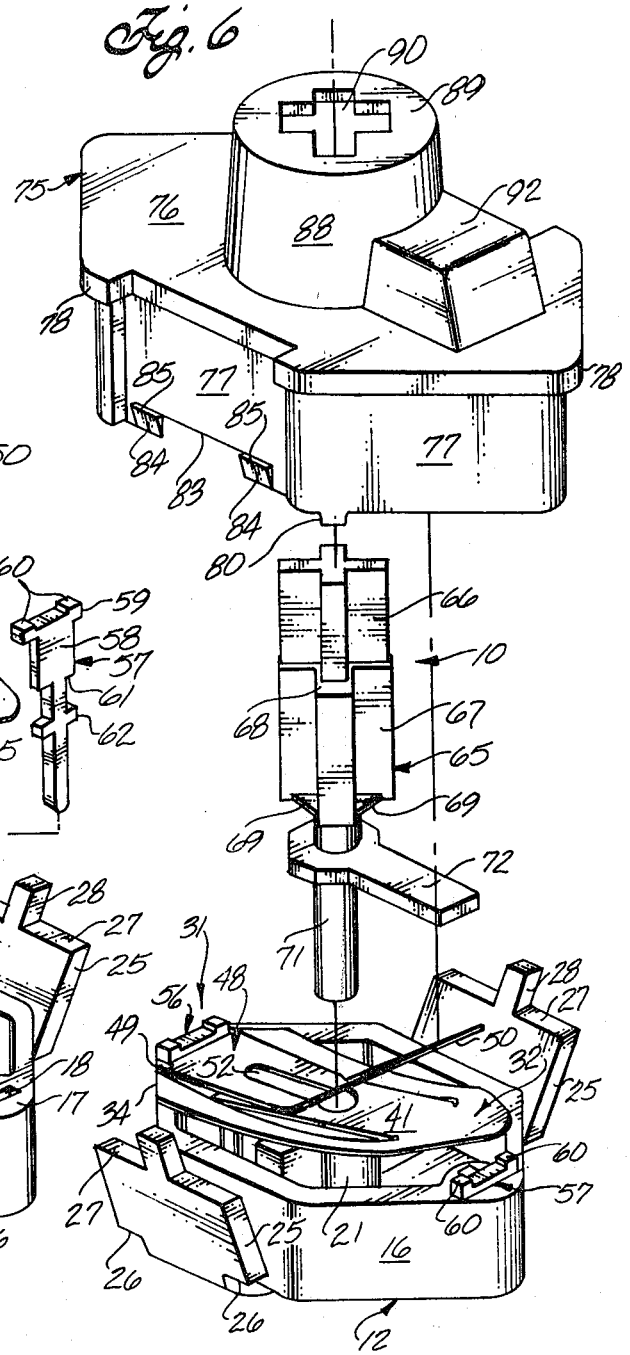
FIG. 6 is an exploded view of a base assembly, keystem, and housing cover.

A key switch 10 according to the invention as shown in FIGS. 1, 3 and 4, and the assembly is also shown in exploded view in FIG. 6. The operating components of the key switch are largely enclosed within a housing 11 which includes a base 12 best seen in FIGS. 1 and 5. Although the total switch assembly is basically square in planform as suggested by phantom lines 13 in FIG. 4, two opposing corners of the housing base are truncated to give the base a roughly hexagonal shape as shown in FIG. 5.

The base is molded from an insulating plastic material such as an ABS. The base has a floor 15, and a continuous sidewall 16 extends upwardly from the floor to define the perimeter of the base. The sidewall is internally thickened at opposed corners 17 (FIG. 5) to enable the formation of a pair of terminal-receiving slots 18 which extend vertically through the sidewall.

One of the thickened sidewall corners is further extended inwardly toward the center of the base to form a spring-supporting pillar 20. The floor of the base also defines a centrally positioned and generally cylindrical boss 21 which projects both above and below the floor as shown in FIG. 1. A central keystem-receiving blind bore 22 is formed in the boss. A pair of spring-supporting ledges 23 (FIG. 5) extend from opposite sides of the boss as best seen in FIG. 5, the ledges protruding slightly above the top of the boss to form a central notch or recess 24.

A pair of locking tabs 25 are integrally formed on opposite sides of base 12, and the tab portion which joins the base is slightly resilient so the upper ends of the tabs can be flexed toward and away from each other. The central portion of each tab is laterally extended to define pairs of lower shoulders 26 and upper shoulders 27. A short post 28 extends from the upper surface of each tab.

Figure 7:
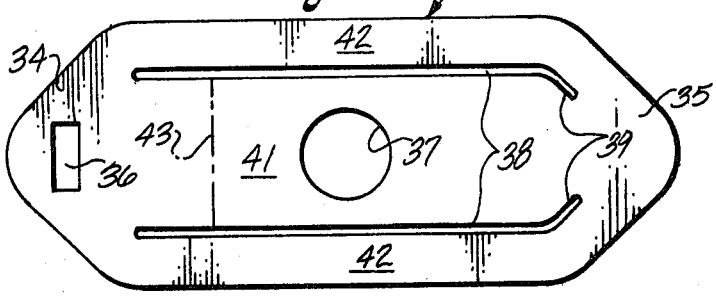
FIG. 7 is a top view of a snap-action spring formed as a flat blank.
Figure 8:
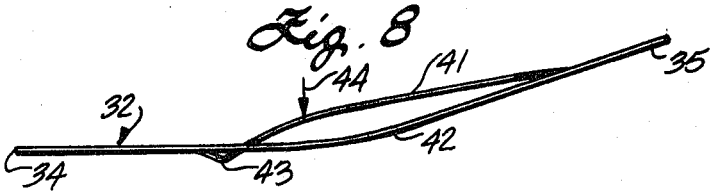
FIG. 8 is a side view of the spring shown in FIG. 7 after final forming.

Base 12 is one component of a base assembly 31, shown in exploded view in FIG. 5, and in assembled form at the bottom of FIG. 6. Another component of the base assembly is a snap-action contact spring 32 (FIGS. 1 and 5–8). The spring is shown in FIG. 7 in a flat form as cut from sheetmetal stock, and FIG. 8 shows the spring after a bending operation which provides the desired stresses for bi-stable snap action.

Referring to FIG. 7, the snap-action spring is generally rectangular in planform, and has tapered first and second ends 34 and 35. A rectangular slot 36 is punched through the spring adjacent first end 34, and a central circular opening 37 is also formed through the spring. A pair of narrow, generally parallel slots 38 extend along the length of the main body of the spring, and these slots have end portions 39 which converge toward each other, but do not intersect. Slots 38 partition the spring into a central arm 41 and a pair of side members 42 positioned on opposite sides of the central arm.

After the several openings described above are formed through the spring, a relatively sharp bend is made in central arm 41 along line 43 (FIG. 7) to deform the arm as best seen in the side view of FIG. 8. The bend in effect shortens the central arm, and flexes the main body of the spring upwardly as shown in FIG. 8. That is, the bend places central arm 41 in tension, and side members 42 in compression, with the bent portion of the central arm extending below the main plane of the spring, and the rest of the central arm being bowed above the surface of the upwardly-flexed side members.

When thus formed, spring 32 is a snap-action element which, when anchored at first end 34, will snap between two bi-stable positions in response to a force applied or released on the central arm as suggested by arrow 44 in FIG. 8. The spring is preferably formed from a highly resilient sheet material, such as full-hard Type 302 stainless steel of about 0.004-inch thickness, and in a typical form, is approximately $\frac{1}{4}$-inch in width and about 11/16-inch in length.

Figure 9:
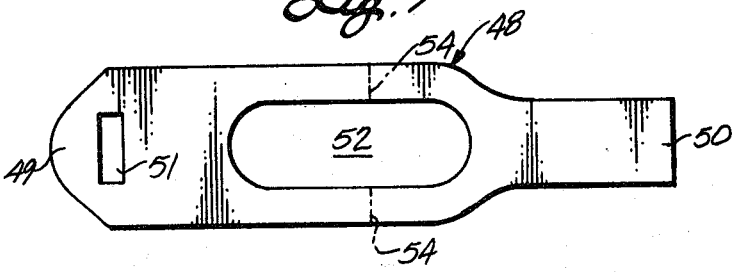
FIG. 9 is a top view of an actuator spring formed as a flat blank.
Figure 10:
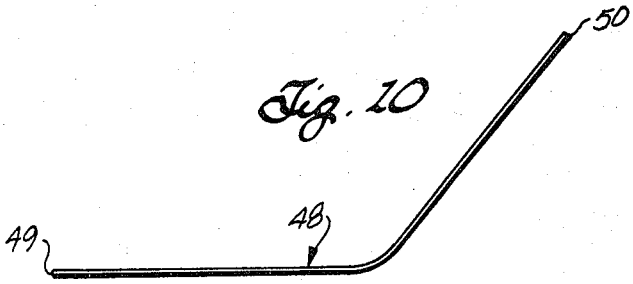
FIG. 10 is a side view of the actuator spring after final forming.

The base assembly 31 also includes an actuator spring 48, as shown in FIGS. 1, 5–6, and 9–10. This spring is also preferably formed from a resilient sheet-metal material such as full-hard Type 302 stainless steel of about 0.005-inch thickness. Spring 48 is an elongated leaf having a first tapered end 49 and an elongated second end 50 of reduced width. A rectangular slot 51 is formed through the spring adjacent first end 49, and an elongated racetrack-shaped opening 52 is cut through the central part of the spring, as best shown in FIG. 9. After these openings are formed, the spring is then bent about a fold line 54 (FIG. 9) so the plane of second end 50 is angled upwardly approximately 50 degrees from the plane of the original flat stamping.

Base assembly 31 is completed by a pair of terminal pins 56 and 57, which provide electrical connections for the switch, as well as securing the several parts of the assembly together. Each pin has a shank 58 with an enlarged head 59 having an upper surface which is centrally recessed to form a pair of pads or contacts 60. The shank is reduced in width at shoulders 61, and includes a pair of laterally-extending locking tabs 62 positioned below these shoulders. As best seen in FIG. 1 the upper surface of the locking tabs is spaced from the under-surface of enlarged head 59 by a distance corresponding approximately to the height of terminal-receiving slots 18 in base 12. The terminal pins are stamped from a conductive material such as 70-30 cartridge brase (one-quarter to one-half hard), and pin 57 should be gold plated to provide a good electrical contact surface on contacts 60.

The components thus far described are assembled to form base assembly 31 in a manner best seen in FIGS. 5 and 6. The first ends 34 and 49 of the two springs are positioned over spring-supporting pillar of the base with rectangular slots 36 and 51 in alignment with terminal-receiving slot 18 adjacent the spring-supporting pillar. Terminal pin 56 is then inserted through the rectangular slots in the springs, and into the terminal-receiving slot of the base.

With the parts thus supported as shown at the bottom of FIG. 6, the lower end of shank 58 is twisted about 45 degrees to move locking tabs 62 out of alignment with slot 18 as shown in FIG. 1. The twisting action locks the terminal pin to the base and securely fastens the two springs against the top surface of the base against spring-supporting pillar 20. Terminal pin 57 is inserted and locked in the same fashion, but this pin serves solely as a terminal and switch-contact surface, and accordingly does not pass through and clamp the two springs.

The next component of the switch 10 is an elongated keystem 65 as shown in FIGS. 1, 3–4, and 6. The keystem is preferably integrally molded from a plastic material such as sold under the trademark "Delrin". The keystem defines a cross-shaped or cruciform head 66, and an enlarged cruciform bearing portion 67 extending axially below the head. The four arms of cruciform head 66 are uniformly dimensioned and spaced with respect to the axial centerline of the keystem as shown in FIG. 4. The arms of bearing portion 67 on the other hand, are non-uniform in dimension and include an extended arm 68 which serves a keying function as described below.

Fillets 69 (FIG. 6) are integrally formed between the lower ends of the arms of bearing portion 67 and the upper surfaces of the fillets serve as extension stops for the keystem when the switch is assembled. A cylindrical pin 71 extends axially from the undersurface of the bearing portion. A paddle-shaped tang or tab 72 extends laterally from pin 71 below the bearing portion.

Keystem 10 is completed by a cover 75 which fits over base 12 to form housing 11. The cover is a hollow, molded plastic component which is generally similar in planform to base 12, and is preferably made from an ABS plastic material. The cover has a central, generally hexagonal platform 76, and a sidewall 77 depends from the undersurface of the platform. The upper end of the sidewall on four of the six sides of the platform is laterally extended to define flanges 78.

A plurality of short tabs 80 extend downwardly from the undersurface of sidewall 77, and the tabs are useful for positioning the keyswitch against a circuit board when a number of switches are mounted together to form a keyboard. The inner surface of the sidewall also defines four inwardly-extending ribs 81 (FIGS. 1 and 2) which terminate about midway toward the lower end of the sidewall. The bottoms of the ribs define stops, against which the upper surface of base 12 is abutted when the base and cover are assembled.

Figure 2:
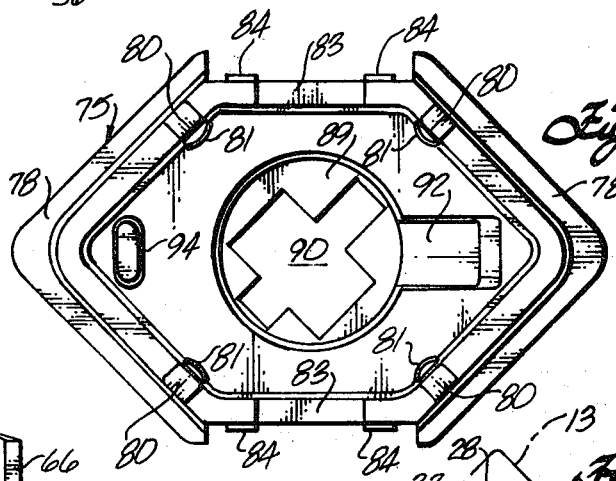
FIG. 2 is a bottom view of a housing cover on line 2—2 of FIG. 1.

A pair of upwardly extending notches 83 are formed in the lower end of opposite sides of sidewall 77 as best seen in FIGS. 2 and 6. A wedge-shaped projection 84 extends outwardly from each end of each notch 83, and the upper surface of each projection defines a shoulder 85.

A generally cylindrical hollow turret 88 extends upwardly from the center of platform 76 of the cover, and a top wall 89 extends across the top of the turret. A keyed cruciform slot 90 is formed through top wall 89 and is dimensioned so bearing portion 67 of keystem 65 will make a mating slip fit through the slot. A turret extension 92 projects laterally from one side of turret 88, and the undersurface of the extension defines a recess 93 (FIGS. 1 and 2) which provides a clearance space for keystem tab 72 when the switch is assembled as shown in FIG. 1. A terminal clamping post 94 extends downwardly from the undersurface of platform 76 adjacent sidewall 77 and opposite recess 93.

To assemble the keyswitch, keystem 65 is inserted into the interior of housing cover 75 until head 66 and bearing portion 67 extend through the top of turret top wall 89. The keystem cannot be improperly positioned due to the keying action of bearing portion 67 in slot 90 of the turret top wall. Fillets 69 at the lower end of the keystem bearing portion seat against the undersurface of top wall 89 to provide a limit stop for upward movement of the keystem. When thus assembled, and as shown in FIG. 1, keystem tab 72 is positioned within recess 93 of the turret extension.

Base assembly 31 is then fitted into the bottom of the housing cover, with keystem pin 71 fitted into blind bore 22 of the base. The base and cover make an interference fit, and the parts are pressed together until the upper surface of the base abuts the underside of ribs 81. When the base is fully seated in this position, locking tabs 25 on the base snap inwardly to place lower shoulders 26 over and against shoulders 85 of wedge-shaped projections 84 on the cover, thus locking the base and cover together. A conventional key cap 95 (shown in phantom line in FIG. 1), bearing a designation (not shown) of the switch function, is then pressed over head 66 to be engaged with the keystem.

When thus assembled, keystem tab 72 bears against the cantilevered free second end of actuator spring 48, as shown in FIG. 1, and the combined restoring forces exerted by the actuator and snap-action springs (which are slightly compressed in this position), serve to urge the keystem into a fully extended position in which the switch is open. The two springs are clamped to the base by terminal pin 56, and are also supported by the upper surface of spring-supporting pillar 20 and ledges 23 of the base. The remaining length of the two springs is cantilevered from these clamped portions across the interior of the switch housing, and pin 71 of the keystem passes through spring openings 37 and 52. The lower end of post 94 is pressed against the head of terminal pin 56 to insure that the clamping action of the pin against the springs will not be loosened by, for example, application of heat to the terminal shank when the switch is soldered into a circuit.

To actuate the switch, keystem 65 is depressed by finger pressure against key cap 95, driving downwardly keystem tab 72 and free second end 50 of the actuator spring. The portion of the actuator spring adjacent fold-line 54 bears against the central part of arm 41 of the snap-action spring. Continued downward displacement of the central arm of the snap-action spring causes the central arm to snap "through center", snapping second end 35 of the snap-action spring downwardly against contacts 60 on terminal pin 57, thus closing an electrical circuit between the two terminal pins. Continued downward movement of the keystem has no effect on the switch closure, and such movement is limited when keystem pin 71 abuts the bottom of blind bore 22 in the base.

The keystem stops (fillets 69 in the extended position, and the bottom of bore 22 in the fully depressed position) are positioned to provide a total keystem stroke of about 0.160 inch. The springs are configured to actuate the switch when the keystem has been depressed about 0.100 inch, and the keystem accordingly has about 0.060-inch overtravel beyond the actuation point as is desirable in this style of switch.

When the switch is not actuated, a restoring force or pre-load of about 30 grams is exerted on the keystem by the slightly deflected actuator and snap-action springs. This arrangement eliminates need for a separate return spring to drive the keystem to the fully extended position upon release of the key cap by the operator. The springs are configured to require an actuating force of about 75 grams on the key cap to drive the keystem to the actuating point of about 0.100-inch travel. When the snap-action spring snaps into the actuated position, the restoring force exerted by the springs on the keystem abruptly decreases by about 5 to 10 grams, providing the operator with the desired tactile signal of switch actuation.

It is characteristic of snap-action spring 32 that the force applied to the spring to close the switch is considerably higher than the force at which the spring will snap back to the open or non-actuated position. In terms of keystem displacement (which is directly related to the force applied by the actuating spring to the snap-action element), the keystem must be permitted to raise toward the extended position about 0.030 inch above the closure actuation point before the snap-action element returns to its normal position to open the contacts. The switch is thus provided with the desired hysteresis characteristic which prevents contact jitter if the keystem is held at about the downstroke actuation point.

The cantilevered configuration of the springs and keystem tab 72 provide several important advantages in the functioning and reliability of the switch. Relatively long leaf springs can be used to avoid high local stresses which can produce fatigue failure in the spring metal. In this respect, advantage is taken of the oblong shape of the housing interior by orienting the springs along the longest dimension of the housing.

Another significant advantage is that the leveraged arrangement of the keystem tab and actuator spring provides a mechanical advantage permitting use of a relatively heavy snap-action element to maintain high contact pressure when the switch is closed. The snap-action spring is designed to require about 125 grams of force on central arm 41 to drive the spring through center and close the switch contacts. If the keystem acted directly on the snap-action element, the full load of 125 grams would have to be applied by the operator. The disclosed arrangement, however, applies the operator's relatively light finger pressure through cantilevered keystem tab 72 to the free second end of the actuator spring, causing a larger force to be applied to central arm through a relatively small displacement which is adequate to drive the snap-action "over center" to close the switch contacts.

While the switch has been disclosed in a presently preferred form, it is to be understood that other styles of snap-action elements can be used. For example, a suitable alternative spring can be formed by crimping the side members of the spring to place the central arm in compression in either case, the side members are adequately supported by ledges 23 on the housing base, and recess 24 between the ledges provides clearance for movement of the central arm when the switch is actuated.

The keystem supporting arrangement is especially advantageous in that accurate guidance is provided by bearing portion 67, and by pin 71 as fitted into bore 22 of the base. These components provide bearing surfaces which are well spaced apart to provide the switch with a smooth, low-friction stroke even though keystem side loads may be applied by the operator. The overall geometry of the switch, and the extension of boss 21 beneath the floor of the base, provides this functional separation of the bearing surfaces without affecting the desirable "low profile" short projection of the upper part of the switch above mounting-panel flanges 78. Internal friction-producing loads on the keystem are also minimized because the direction of the force applied to the snap-action spring is generally parallel to and in alignment with the direction of keystem axial motion.

Mounting of the switch in a keyboard array is conventional, and the housing is dimensioned so a plurality of switches can be arranged on centers which are spaced apart by three-fourths inch or less. Tabs 80 can be used for switch positioning on a printed-circuit board or the like, and electrical connections are made directly to the protruding shanks of the two terminal pins. In a typical mounting arrangement, flanges 78 of the housing cover abut a panel which is apertured to receive the lower end of the housing, and the switch is secured by the panel which is captive between the flanges and upper shoulders 27 of locking tabs 25 (clearance for which is provided by truncating the two opposed corners of the otherwise basically square housing planform).

Key switch 10 which provides all of the desired operating characteristics for this style of component, with a significant reduction in the number of parts required, and without need for adherence to close dimensional tolerances. Use of coil springs (which are awkward to handle and tend to tangle during assembly operations) is avoided, and the need for a separate keystem return spring is eliminated. Assembly of the switch is essentially a "snap together" operation after the multi-function terminal pins are twisted to be locked in place.

Figure 11:
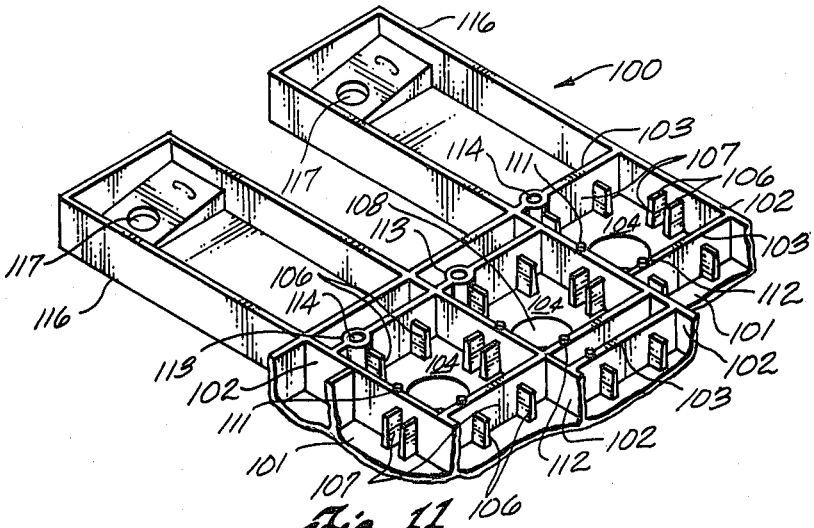
FIG. 11 is a pictorial bottom view of a portion of a keyboard housing cover for another embodiment of a key switch used as one element of an array of switches forming a keyboard.
Figure 12:
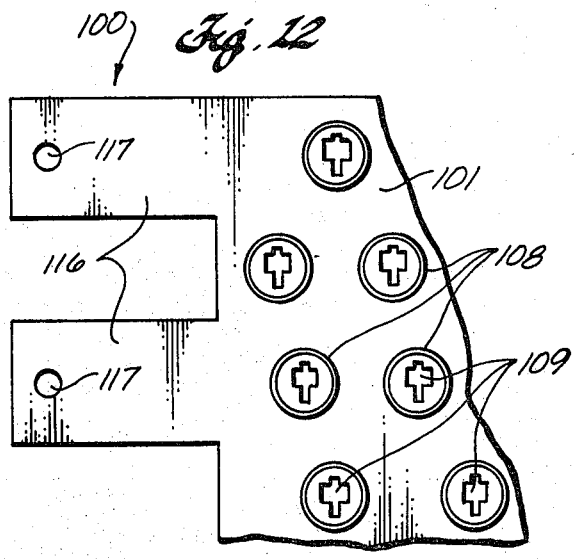
FIG. 12 is a top plan view of the keyboard housing cover.

A second embodiment of the invention is shown in FIGS. 11–23, and this embodiment is useful in providing an integrated array of individual key switches forming a keyboard. The individual key switches are mounted in a housing which includes a cover 100 as best seen in FIGS. 11–12. The cover is an integrally molded plastic part which accommodates enough individual key switches to form, for example, a keyboard for a typewriter, teletype, computer-entry device, and the like.

Cover 100 has a top panel 101 with a plurality of downwardly extending longitudinal walls 102 and lateral walls 103 which intersect to define individual cells or compartments 104 to accommodate the individual key switches. Extending from the inner surface of each of the four walls defining a compartment 104 are a pair of tabs 106 which are spaced apart to define a channel 107 (FIGS. 11 and 13) in which a keystem is received as further described below. A hollow and centrally positioned turret 108 extends from the upper surface of panel 101 above each compartment 104 as best seen in FIGS. 12 and 21, and the top surface of each turret defines a keyed cruciform slot 109 (FIG. 12).

One of the longitudinal walls of each compartment 104 defines a downwardly extending locating pin 111, and one of the lateral walls of each compartment defines a downwardly extending locking pin 112. Enlarged bosses 113 are periodically positioned along the housing cover in the lateral walls, and each boss has a central threaded recess 114 to receive a screw (not shown) when the keyboard is assembled. Longitudinal walls 102 are extended beyond the matrix of compartments 104 to provide mounting arms 116 with openings 117 therethrough enabling the keyboard assembly to be secured to another device.

Each row of compartments in the housing cover is fitted with a spring-metal strip 120 which defines a plurality of snap-action springs 121 (FIGS. 14–18). The strip has a longitudinally extended base 122 having evenly spaced lateral extensions 123. The end of each lateral extension is bifurcated and curved (FIG. 15) to form a pair of contact fingers 124. The body of each lateral extension also defines a generally rectangular opening 125 with a short tab 126 extending into this opening. Circular openings 127 are formed through base 122 intermediate each pair of lateral extensions 123, and these openings are positioned to receive locating pins 111 on the housing cover.

Each snap-action spring 121 is supported at the end of a tab 129 which extends longitudinally from one side of the associated lateral extension 123. After being stamped from a larger sheet of spring metal, the snap-action spring is a generally rectangular flat panel. A pair of longitudinally extending grooves 130 are then formed at opposite ends of the panel to deform it into a stressed and arcuately bowed snap-action spring.

When viewed from the side as shown in FIG. 18, the spring is similar in shape to a steel measuring tape, and pressure applied at the central part of the top surface of the spring deforms the spring into a second bi-stable position, providing the desired snap-action. A pair of elongated contacts 132 are partially severed from the main body of the snap-action spring, and are bent to extend slightly below the undersurface of the spring as shown in FIG. 17.

Referring to FIGS. 19 and 20, a second spring-metal strip 135 defines a plurality of actuator springs 136. The strip includes a longitudinally elongated base 137 having spaced circular openings 138 (similar to openings 127 in base 122 of the strip of snap-action springs) to receive locating pins 111.

Strip 135 is shown as a flat blank in FIG. 19 as stamped from a larger sheet of spring metal. Longitudinally spaced-apart lateral extensions 140 extend from the base, and each lateral extension has a circular opening 141 to receive locking pin 112 on the housing cover. Each actuator spring 136 extends longitudinally from the associated lateral extension 140, and each spring has a generally rectangular end portion 143 integrally joined at a fold line 144 with a tapered intermediate portion 145 which is integrally joined with the end of lateral extension 140.

The originally flat actuator spring is then bent into final form as shown in FIG. 20 by several further steps. First, a downwardly extending dimple or depression 147 is formed adjacent fold line 144 in the position indicated by phantom line 148 in FIG. 19. A free terminal end 149 of the spring is then bent into a curved configuration (FIG. 20) along phantom line 150 in FIG. 19. Finally, the actuator spring is bent upwardly along fold line 144, and also where the intermediate portion joins lateral extension 140 as shown in FIG. 20.

Each key switch of the array is fitted with a keystem 153 (FIGS. 13 and 21–23) which is preferably integrally molded from a plastic material. The keystem has a base 154, and a pair of stops 155 extend from opposite sides of the base to terminate in downwardly extending tips 156. A guide tab 157 extends from a third side of the base, and a second guide tab 158 of enlarged width extends from the base opposite tab 157.

A post 159 extends upwardly from the top of base 154, and a pair of guide blocks 160 are formed on opposite sides of the post to give the upper end of the post a generally cruciform cross-section which makes a slip fit within cruciform slot 109 in the housing cover. An angled cruciform head 161 extends from the top of post 159 to receive a key cap 162 (FIG. 21) of the type already described. Angulation of the head may be eliminated if no slope of the top of the key cap is desired.

Figure 13:
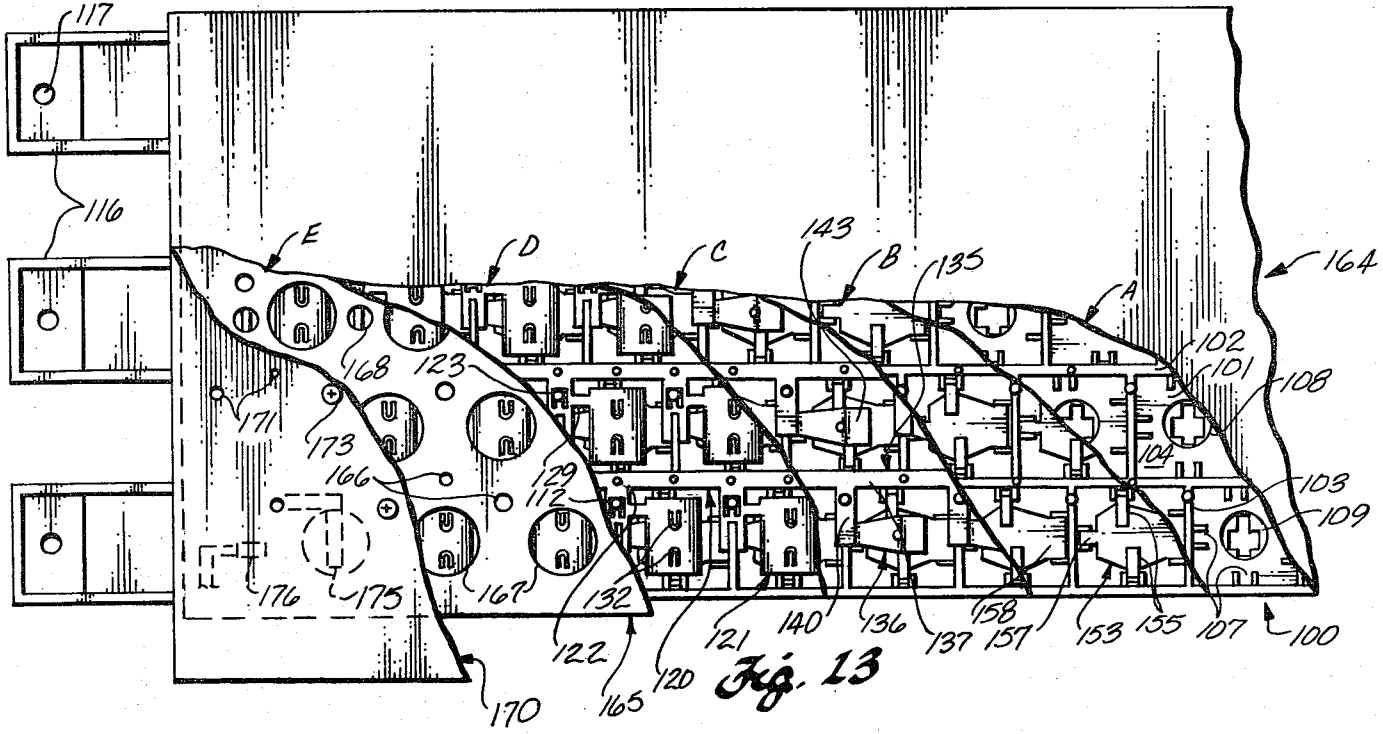
FIG. 13 is a bottom view, partly broken away, of a keyboard assembly.

FIG. 13 is a multiply broken-away bottom view of housing cover 100 showing the addition of the various components which are assembled to form a complete keyboard assembly 164. Portion A of FIG. 13 is a bottom view of a portion of the housing cover alone. Portion B of this figure shows the appearance of the assembly after a plurality of keystems 153 have been fitted into the housing cover with stops 155 and guide tabs 157 received in channels 107, and keystem posts 159 positioned within turrets 108 so the upper ends of the posts project beyond the top of the turrets with heads 161 accessible for the fitting of key caps.

The next step in the assembly process is to position a plurality of strips 135 over locating pins 111 and against the undersurface of the housing cover to position an actuator spring 136 over each compartment 104 as shown in Portion C of FIG. 13. Strips 135 are further positioned by locking pins 112 which fit within circular openings 141 in each strip of actuator springs.

Referring to Portion D of FIG. 13, a plurality of strips 120 of snap-action springs are then superimposed over the strips 135, with circular openings 127 receiving locating pins 111 to insure proper alignment of the strips. Rectangular openings 125 in strip 120 make an interference fit over locking pins 112, and tabs 126 in each opening 125 grip the locking pins to hold the strips of snap-action springs in place.

Referring now to Portion E of FIG. 13, a sheet 165 of an insulating plastic material is fitted over the superimposed strips of actuator and snap-action springs. The sheet has openings 166 to receive pins 111 and 112 on the housing cover to insure proper alignment of the sheet with respect to the several compartments 104.

A plurality of relatively large circular openings 167 are formed through the dielectric sheet, and each opening 167 is centrally positioned over an associated compartment 104 to expose contacts 132 on the snap-action springs. At least one circular opening 168 is also formed through the sheet for each row of large openings 167, and opening 168 is aligned with one set of contact fingers 124 on each strip of snap-action springs.

The final step of the assembly process is to fit a printed-circuit board 170 over insulating sheet 165, the board having a plurality of small openings 171 to receive locating pins 111 and locking pins 112 to insure proper alignment of the board with the other components of the keyboard. The printed-circuit board is secured in place by screws 173 which are threaded into recesses 114 in the housing cover. The printed-circuit board thus forms a base for the keyboard, and completes the housing for each individual key switch.

As is conventional in keyboard assemblies of this type, the upper surface of the printed-circuit board bears a plurality of plated conductive terminal strips 175 (shown in phantom line in FIG. 13), each strip being centered over an opening 167 in the insulating sheet to underlie contacts 132. Common contact terminal strips 176 are also positioned on the board in alignment with openings 168 and in electrical contact with contact fingers 124. The common contact strips thus place the strips of snap-action springs in connection with the circuit board, and individual switch closures are completed when a snap-action spring is driven "through center" by depression of the associated key cap and keystem to snap movable switch contacts 132 against the underlying individual conductive strip 175 which serves as a fixed switch contact.

Upward movement of the keystem is limited by the top surface of keystem base 154 which abuts the undersurface of housing-cover top panel 101 (FIG. 21) until the keystem is depressed. Downward movement of the keystem is limited by stop tips 156 which straddle the snap-action spring to abut the top surface of the printed-circuit board. As in the first key switch embodiment described above, the actuator and snap-action springs are configured to close the switch before the keystem bottoms, providing the desired characteristics of overtravel, tactile sensing of switch closure, and hysteresis to prevent "teasing" of the switch contact at the closure point.

What is claimed is:

1. A key switch comprising:

a housing;

first and second terminals secured to the housing, the first terminal having a portion defining a fixed switch contact;

a bi-stable snap-action conductive spring secured to the housing and in electrical connection with the second terminal, said snap-action spring being movable between first and second bi-stable positions and having a portion defining a movable switch contact positioned above and normally out of engagement with the fixed contact in said first position;

an actuator spring secured at one end to the housing and having a free end and an intermediate portion located between said one end and said free end, said intermediate portion being disposed above said snap-action spring, said free end being movable downwardly to urge said intermediate portion against the snap-action spring;

a keystem slidably mounted on the housing above said springs and having a portion positioned to bear on the free end of the actuator spring, downward depression of said keystem causing an actuating force to be applied through said intermediate portion of the actuator spring to the snap-action spring to bring said movable switch contact into engagement with said fixed switch contact, the direction of the actuating force being generally parallel to the direction of keystem motion; and said snap-action spring returning by its inherent resilience to said first position when the downward pressure on said keystem is released.

2. The switch defined in claim 1, wherein the keystem portion which contacts the actuator spring is laterally extended to contact the actuator spring at a position laterally displaced from a central axis of the keystem, the central axis being generally parallel to the direction of keystem motion and passing through the approximate point of actuating force application on the snap-action spring, the free end of the actuating spring being displaced about a lever arm with respect to the point of actuating force application.

3. The switch defined in claim 1, wherein the central axis of the keystem passes through said actuator-spring intermediate portion which contacts the snap-action spring.

4. A key switch, comprising:

a housing;

a fixed switch contact on the housing;

elongated snap-action spring means having a first end secured to the housing, and a cantilevered portion extending away from the first end to a free second end defining a movable switch contact which can be displaced between first and second bi-stable positions in which the contacts are open and closed respectively in response to an actuating force applied to the snap-action spring means;

elongated actuator spring means having a first end secured to the housing, a cantilevered portion extending away from the first end to a free second end, and an intermediate portion which acts against the snap-action spring to apply said actuating force;

an elongated keystem slidably mounted on the housing and having a portion extending laterally from the central axis of said keystem in contact with the free end of said actuator spring means to deflect the actuator spring means in response to keystem movement and thereby to deflect and actuate the snap-action spring means; and said actuator spring means and said snap-action spring means being constructed such that deflection of said actuator spring means by said keystem will cause the free end of the actuator spring means to be deflected through a larger displacement than a displacement of the snap-action spring means which is necessary to drive the snap-action spring from the first position to the second position, thereby providing a mechanical advantage enabling keystem actuating force to be lower than the actuating force of the snap-action spring means.

5. The switch defined in claim 4, wherein the keystem comprises a head configured to receive a key cap, a bearing portion adjacent the head and in sliding engagement with the housing and an elongated pin extending from the bearing portion and having an end in sliding engagement with the housing.

6. The switch defined in claim 5, wherein the snap-action spring means and the actuator spring means are provided with clearance openings, and the keystem pin extends through the openings, the two said spring means being between the bearing portion and pin end of the keystem.

7. The switch defined in claim 6, wherein the housing includes a base having a generally planar undersurface, the base defining a boss with a blind bore and extending beneath said undersurface, the keystem pin end being received in the bore.

8. The switch defined in claim 7, wherein the boss further defines an upper ledge for supporting a portion of the snap-action spring means at a position generally intermediate the first and second ends of the snap-action spring means.

9. The switch defined in claim 8, wherein the housing has a generally oblong hollow interior, the two spring means extending the longest dimension of the oblong interior.

10. The switch defined in claim 9, and further comprising a terminal pin secured to the housing and having an enlarged head which clamps the first ends of the two spring means together and to the housing.

11. A keyboard assembly, comprising;

a housing;

a printed circuit board underlying said housing;

a plurality of key switches supported on the housing;

each key switch having a conductive snap-action spring carrying a movable contact normally spaced apart from a fixed contact on the printed circuit board, an actuator spring having a free end which is movable to deflect a portion of the actuator spring against the snap-action spring, and a keystem movably mounted on the housing and having a portion positioned to bear on the free end of the actuator spring to apply an actuating force through the actuator spring to the snap-action spring to close the contacts, the direction of actuating force being generally parallel to the direction of keystem motion;

at least some of the key switches being arranged in rows, the key switches in a given row having snap-action springs which are integrally connected together by a first narrow conductive strip, and said key switches in said given row having actuator springs which are integrally connected together by a second narrow conductive strip parallel to and overlying said first strip; and said first and second conductive strips being clamped between said housing and said board.

12. A key switch comprising:

a housing including a base and a cover;

a fixed switch contact on said base;

a bi-stable snap-action conductive spring secured to the housing, said snap-action spring being movable between first and second bi-stable positions and having a portion defining a movable switch contact positioned above and normally out of engagement with the fixed contact in said first position;

an actuator spring secured at one end to the housing and having a free end and a second portion, said second portion being closer to said one end than is said free end, said second portion being disposed above said snap-action spring, said free end being movable downwardly to urge said second portion against the snap-action spring;

a keystem slidably mounted on the housing above said springs and having a portion positioned to bear on the free end of said actuator spring, downward depression of said keystem causing an actuating force to be applied through said second portion of the actuator spring to the snap-action spring to bring said movable switch contact into engagement with said fixed switch contact, the direction of the actuating force being generally parallel to the direction of keystem motion;

said snap-action spring returning by its inherent resilience to said first position when the downward pressure on said keystem is released;

said snap-action spring being a generally rectangular sheet of spring metal having a pair of parallel sides and two generally parallel ends;

said sheet being bowed between said sides to provide an upraised intermediate section engageable by said second portion of said actuator spring;

said intermediate section embodying said movable switch contact; and said ends having grooves formed therein stressing said sheet into said bowed configuration.

13. The switch defined in claim 12 wherein:

said base is a printed circuit board underlying said cover and having a conductive layer thereon providing said fixed switch contact.

14. The switch defined in claim 13 wherein:

said snap-action spring and said actuator spring are secured to said housing by being clamped between said printed circuit board and said cover.

15. The switch as defined in claim 13 wherein:

said printed circuit board has a second conductive layer thereon; and said snap-action spring has a spring finger attached thereto engaging said second conductive layer.

16. The switch as defined in claim 12 wherein:

said movable switch contact is an elongated finger stamped from said intermediate section and bent downwardly toward said fixed contact, said finger being parallel to said sides.

17. A key switch, comprising:

a housing;

a fixed switch contact on the housing;

snap-action spring means having a first end secured to the housing, and an upraised portion extending away from the first end to a movable portion defining a movable switch contact which can be displaced between first and second bi-stable positions in which the contacts are open and closed respectively in response to an actuating force applied to the snap-action spring means;

elongated actuator spring means having a first end secured to the housing, a cantilevered portion extending away from said first end to a free second end, and a second portion which is closer to said first end than is said free end and acts against the snap-action spring to apply said actuating force;

an elongated keystem slidably mounted on the housing and having a portion extending laterally from the central axis of said keystem positioned to contact the free end of said actuator spring means to deflect the actuator spring means in response to keystem movement and thereby to deflect and actuate the snap-action spring means; and said actuator spring means and said snap-action spring means being constructed such that deflection of said actuator spring means by said keystem will cause the free end of the actuator spring means to be deflected through a larger displacement than a displacement of the snap-action spring means which is necessary to drive the snap-action spring from the first position to the second position, thereby providing a mechanical advantage enabling keystem actuating force to be lower than the actuating force of the snap-action spring means.

18. A keyboard assembly comprising:

a printed circuit board having at least one row of conductive layers thereon;

a housing mounted on said board and embodying at least one row of key switch cavities open to said board, each said cavity being positioned over a corresponding one of said conductive layers;

a snap-action spring in each said cavity embodying a movable contact normally spaced above said corresponding conductive layer;

a first conductive strip between said housing and said board interconnecting at least some of said snap-action springs;

an actuator spring in each said cavity above said snap-action spring, said actuator spring having a free end movable to urge a portion of the actuator spring against the snap-action spring;

a second conductive strip between said housing and said board interconnecting at least some of said actuator springs; and a plurality of keystems mounted on said housing each for one of said cavities, each said keystem having a portion positioned to bear on the free end of the actuator spring in its respective cavity to apply an actuating force through the actuator spring to the snap-action spring to cause said movable contact to engage said corresponding conductive layer, the direction of actuating force being generally parallel to the direction of keystem motion.

19. The keyboard assembly defined in claim 18 wherein:

said second conductive strip overlies said first conductive strip.

20. The keyboard assembly defined in claim 19 wherein:

said housing embodies intersecting longitudinal and lateral walls defining said cavities;

one of said longitudinal walls embodying downwardly extending locating pins; and said first and second conductive strips underlying said one longitudinal wall and embodying aligned openings receiving said pins.

21. The keyboard assembly defined in claim 18 wherein:

said printed circuit board has a second conductive layer thereon underlying one of said cavities; and said first conductive strip has a spring finger attached thereto engaging said second conductive layer.

22. The keyboard assembly as defined in claim 21 wherein:

said spring finger is formed on a lateral extension of said first conductive strip;

said snap-action spring is a generally rectangular sheet of spring metal bowed between a pair of generally parallel sides providing an upraised intermediate section engageable by said portion of said actuator spring;

said parallel sides of said snap-action spring being generally perpendicular to said first conductive strip; and a tab connecting one of said sides of said snap-action spring to said lateral extension.

* * * * *